US005952776A

United States Patent [19]

Van Doorn et al.

[11] Patent Number: 5,952,776

[45] Date of Patent: Sep. 14, 1999

[54] COLOR DISPLAY DEVICE WITH PHOSPHOR REGIONS AND CORRESPONDING COLOR-FILTER LAYERS

[75] Inventors: Arie R. Van Doorn; Godefridus P. Van Melis, both of Eindhoven, Netherlands

[73] Assignee: U.S. Philips Corporation, New York, N.Y.

[21] Appl. No.: 08/950,570

[22] Filed: Oct. 15, 1997

[30] Foreign Application Priority Data

Oct. 17, 1996 [EP] European Pat. Off. ..... 96202890

[51] Int. Cl.[6] ..... H01J 29/10

[52] U.S. Cl. ..... 313/461; 313/466; 313/463; 313/473; 313/474; 313/112; 313/110

[58] Field of Search ..... 313/461, 466, 313/463, 473, 474, 112, 110

[56] References Cited

U.S. PATENT DOCUMENTS

| | | | |
|---|---|---|---|
| 5,045,750 | 9/1991 | Itou et al. | 313/466 |
| 5,686,787 | 11/1997 | Itou et al. | 313/461 |
| 5,700,609 | 12/1997 | Matsuda et al. | 430/27 |
| 5,703,431 | 12/1997 | Itou et al. | 313/461 |

*Primary Examiner*—Sandra O'Shea
*Assistant Examiner*—Ronald E. Delgizzi
*Attorney, Agent, or Firm*—John C. Fox

[57] ABSTRACT

A color display device is provided with a black-matrix layer, a phosphor pattern and color-filter layers. The theological behavior of the suspension and/or the evaporation of volatile constituents is influenced by the topology of the color-filter layers, with, in particular, projecting color-filter layers exerting an influence. As a result, variations in thickness between the phosphor layers occur. By reducing the differences in height between a projecting color-filter layer and the black-matrix layer, the variations in thickness between the phosphor layers are reduced and hence the quality of the picture displayed is improved.

4 Claims, 3 Drawing Sheets

COLOR DISPLAY DEVICE WITH PHOSPHOR REGIONS AND CORRESPONDING COLOR-FILTER LAYERS

CROSS REFERENCE TO RELATED APPLICATIONS

U.S. patent applications Ser. No. 08/950,568 and Ser. No. 08/950,569 also relate to color display devices having color filter layers.

BACKGROUND OF THE INVENTION

The invention relates to a color display device comprising a substrate on which a black-matrix layer having apertures is provided, said color display device having a phosphor pattern for emitting, in operation, light through the apertures in the black-matrix layer, and color-filter layers extending between the phosphor pattern and the substrate.

Color display devices of the type mentioned in the opening paragraph are used, inter alia, in television receivers and computer monitors.

A color display device of the type mentioned in the opening paragraph is known. Said known color display device comprises a phosphor pattern which includes sub-patterns of phosphor regions luminescing red, green and blue light (hereinafter also referred to as "red", "green" and "blue" phosphors) and it further comprises a black-matrix layer. A black-matrix layer is a highly light-absorbing (black) layer provided with apertures or a system of black stripes on the substrate and (in part) between the phosphor regions of which the phosphor pattern is made up, which black-matrix layer improves the contrast of the picture displayed. The black matrix is provided with apertures in which colored layers (also referred to as color-filter layers) are provided, and a phosphor region of a corresponding color is deposited on said colored layers. In operation, the phosphors of the phosphor pattern emit light which leaves the display device via the apertures of the black-matrix layer. The color-filter layer absorbs incident light of different wavelengths than the light emitted by the relevant phosphor. This leads to a reduction of the diffuse reflection of incident light and to an improved contrast of the picture displayed. In addition, the color-filter layer (for example a "red" layer) may absorb a part of the radiation emitted by the "red" phosphor, namely the part having wavelengths outside the red portion of the visible spectrum. By virtue thereof, the color point of the red phosphor is improved. The known color display device comprises a color-filter layer for each of the phosphors (red, green and blue). For clarity, it is observed that "red", "blue" and "green" color-filter regions have a relatively high transmission for, respectively, red, blue and green light. The color indication for the color-filter layers relates to the transmission properties of the filters, not to their color.

The known color display device has a number of shortcomings; in particular, when the phosphor regions are provided on the color-filter layers, inhomogeneities in the thickness of the applied phosphor regions may occur. These inhomogeneities adversely affect the quality of the picture displayed and may cause rejects.

OBJECTS AND SUMMARY OF THE INVENTION

It is an object of the invention to provide a color display device of the type mentioned in the opening paragraph, in which a reduction of one or more of the above-mentioned drawbacks is achieved.

To this end, a color display device in accordance with the invention is characterized in that a first color-filter layer extends over a first system of apertures in the black matrix, which correspond to phosphor regions of a first color, and over the black matrix, with apertures being provided in the first color-filter layer, which correspond to apertures in the black matrix which do not belong to the first system of apertures in the black matrix, and a second color-filter layer extends in the apertures of a second system of apertures in the black matrix, and in that the following relationship applies $$|t_1+t_{BM}-t_2|<|t_2-t_{BM}|$$

wherein $t_1$ is the thickness of the first color-filter layer on the black-matrix layer near the second system of apertures, $t_{BM}$ is the thickness of the black matrix and $t_2$ is the thickness of the second color-filter layer.

In the color display device in accordance with the invention, the first color-filter layer and the second color-filter layer are different in shape. The first color-filter layer is a layer which extends over phosphor regions of the first color and over a large part of the black matrix, and which is provided with apertures which correspond to the apertures of the black matrix which do not belong to the first system of apertures, whereas the second color-filter layer is situated in the apertures of the second system and hence provided with a pattern in separate regions.

At first sight, the fact that the color-filter layers are different seems to have a negative effect, as the first and the second color-filter layer have different shapes and hence use cannot be made of one and the same method to provide both color-filter layers; however the inventors have recognized that this difference between the color-filter layers causes the homogeneity of the phosphor layers to be improved if the other condition of the invention is met, that is, if $|t_1+t_{BM}-t_2|<|t_2-t_{BM}|$. The inventors have further recognized that, during the provision of the phosphors, a projecting color-filter layer causes inhomogeneities in the quantity of phosphor provided. Such inhomogeneities adversely affect the quality of the picture displayed and may be visible as stripes or crosses in the intensity of the picture. The human eye is highly sensitive to such effects. This effect can be reduced by giving the first filter layer a more or less continuous shape and by satisfying the above-mentioned condition. As a result of the presence of the first color-filter layer near the second color-filter layer, the second color-filter layer projects less above the direct surroundings, so that inhomogeneities in one or more phosphor layers are reduced. This has a positive effect on the picture reproduction.

Preferably, the size of the apertures provided in the first color-filter layer is such that said apertures correspond to the apertures of the second system, which are surrounded by an edge. The edge is preferably relatively small relative to the dimensions of the apertures (less than $1/10^{th}$ of the apertures).

In these preferred embodiments, the first color-filter layer leaves an edge around the apertures of the second color uncovered. This leads to an improvement of the color reproduction because no material of the first color filter can deposit in the apertures of the second color.

The difference in height between the thickness of the second color-filter layer and the overall thickness of the first color-filter layer and the black matrix near the second color-filter layer is preferably less than 1 micrometer, that is, preferably the following relationship applies:

$|t_1+t_{BM}-t_2| \leqq 1$ micrometer

A difference in height below 1 micrometer causes no or few inhomogeneities in the thickness of the phosphor layers.

These and other aspects of the invention will be apparent from and elucidated with reference to the embodiments described hereinafter.

BRIEF DESCRIPTION OF THE DRAWINGS

In the drawings.

The Figures are not drawn to scale. In general, like reference numerals refer to like parts.

DESCRIPTION OF THE PREFERRED EMBODIMENTS

Figure 1:
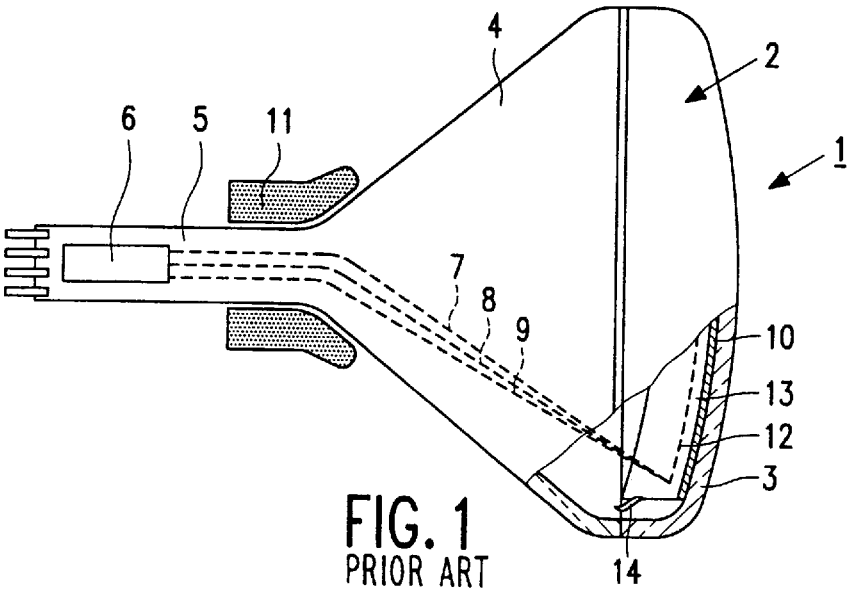
FIG. 1 PRIOR ART
FIG. 1 is a sectional view of a color display tube for a color display device.

A color display tube 1 (FIG. 1) comprises an evacuated envelope 2 including a display window 3, a cone portion 4 and a neck 5. In the neck 5 there is arranged an electron gun 6 for generating three electron beams 7, 8 and 9. A display screen 10 is provided on the inner surface of the display window. Said display screen 10 comprises a phosphor pattern of phosphor elements luminescing in red, green and blue. On their way to the display screen 10, the electron beams 7, 8 and 9 are deflected across the display screen 10 by means of a deflection unit 11 and pass through a shadow mask 12 which is arranged in front of the display window 3 and which comprises a thin plate having apertures. The shadow mask is suspended in the display window by means of suspension means 14. The three electron beams 7, 8 and 9 pass through the apertures 13 of the shadow mask at a small angle relative to each other and, consequently, each electron beam impinges on phosphor elements of only one color.

Figure 2A:
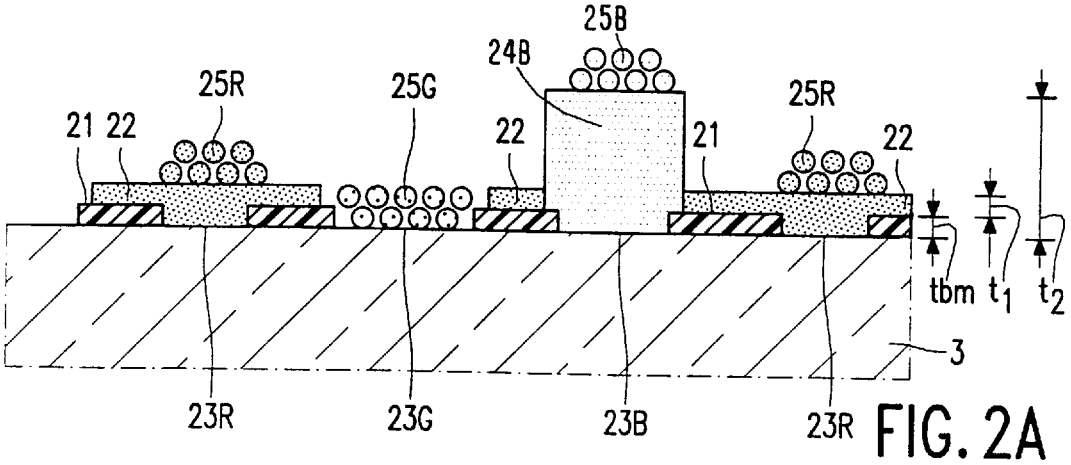
FIG. 2A is a sectional view of a display window for a display tube, which is provided with color-filter layers.
Figure 2B:
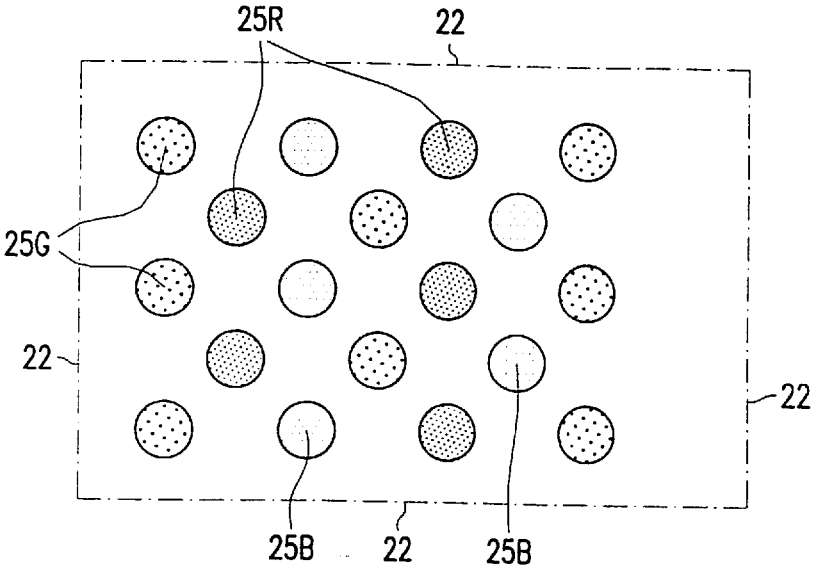
FIG. 2B is an elevational view of a display window for a display tube.

FIG. 2A is a sectional view of a display window of a color cathode ray tube in accordance with the invention. FIG. 2B is an elevational view (on the phosphor elements) of the display window shown in FIG. 2A. A black matrix 21 is provided on the inner surface of the display window. Color-filter layer 22 extends over apertures 23R for R (red) phosphor elements and over the black matrix 21, with the exception of the apertures 23B, 23G for, respectively, the B (blue) and G (green) phosphor elements. Regions of the color-filter layer 24B are provided in the apertures 23B. Said regions of the color-filter layer 24B project above the black matrix. In this example, the thickness $t_2$ of the color-filter layer 24B is 1.5–5 $\mu$m. Phosphors 25R, 25G and 25B are provided above the apertures 23R, 23G and 23B, respectively, with the color-filter layers, if any, extending between the phosphors and the substrate. During the provision of the phosphors, a phosphor suspension flows over the inner surface of the display window. Color-filter regions projecting above the black matrix cause inhomogeneities in the flow of the phosphor suspensions and/or evaporation of the volatile constituents of the suspensions, which causes inhomogeneities in the thickness of the phosphors. At certain locations on the screen, an above average quantity of phosphor is deposited, while at other locations a below average quantity of phosphor is deposited. Such inhomogeneities cause clear and dark regions or regions having a different color in the picture displayed. The differences in height are reduced because, in the invention, the color-filter layer 22 also extends over the black matrix between the blue and, possibly, green color-filter regions. The thickness $t_{BM}$ of the black matrix is, for example, 0.6 micrometer, the thickness $t_1$ of the red color-filter layer 22 is 0.6 micrometer on the black-matrix layer near the apertures 23B, and the thickness $t_2$ of the blue color-filter layer 24B is 2 micrometers. Therefore, the following relationship applies $|t_1+t_{BM}-t_2|=0.8$ micrometer $<|t_2|t_{BM}|=1.4$ micrometers. The presence of the red color-filter layer 22 around the blue regions of the color-filter layer 24B reduces the height of the regions 24B relative to the immediate surroundings, that is, how far these regions 24B project above the surroundings, by 45%. By virtue thereof, the homogeneity of the phosphor layers is improved. FIG. 2A also shows an aspect of a preferred embodiment of the invention, namely that the color-filter layer 22 leaves an edge around the apertures 23B uncovered. By virtue thereof, the presence of "red" color-filter material in apertures 23B and/or 23G is precluded. This leads to an improved color reproduction. It is noted that in the relevant literature mention is made of pigmented phosphors, with the phosphor particles being surrounded by a pigment layer, as an alternative to color-filter layers. However, the pigment does not only influence the light emitted by the phosphor but also the efficiency with which the phosphors are excited by electrons.

Figure 3A:
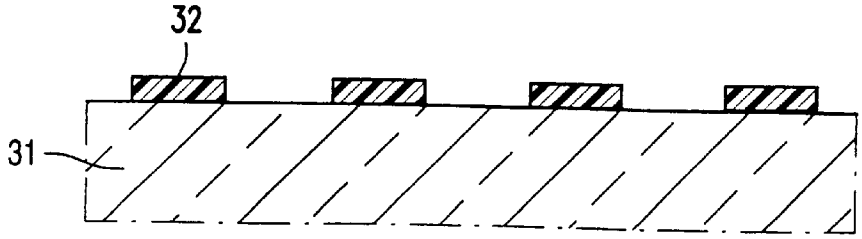
FIGS. 3A through 3J illustrate an example of a method of manufacturing the color-display device in accordance with the invention.
Figure 3B:
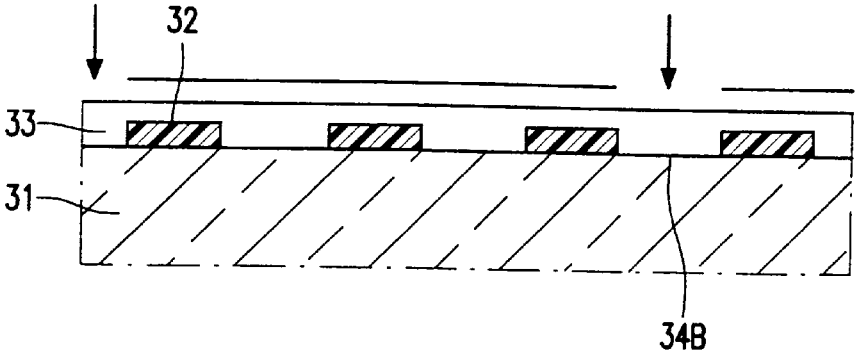
Figure 3C:
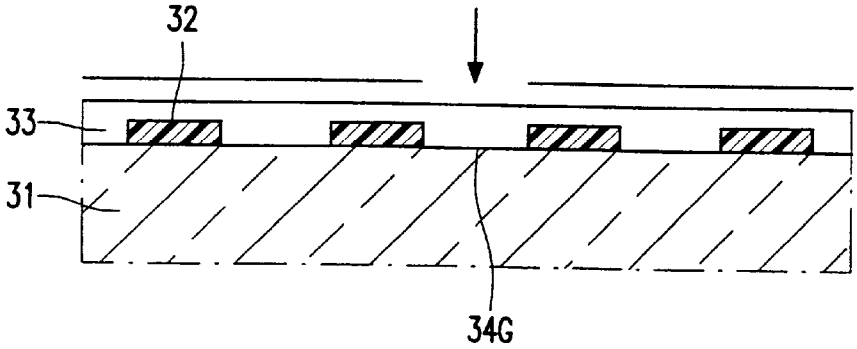
Figure 3D:
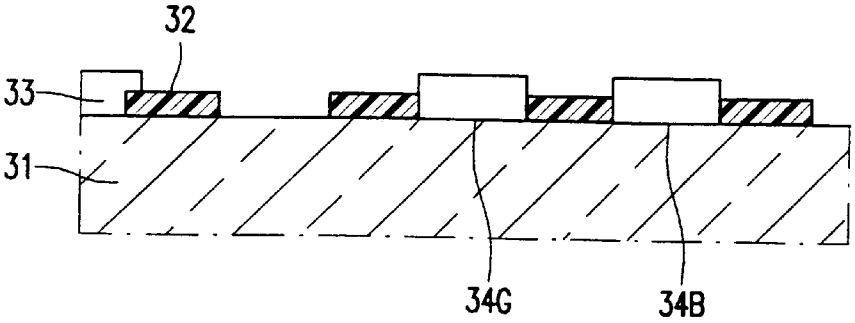
Figure 3E:
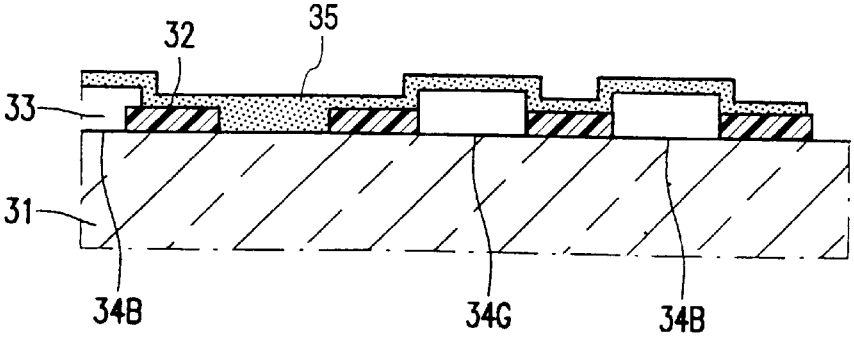
Figure 3F:
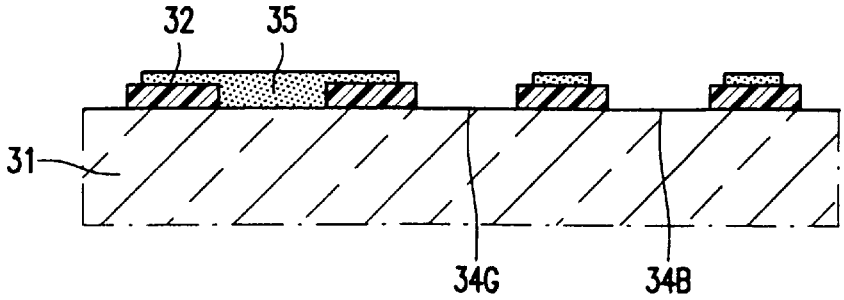
Figure 3G:
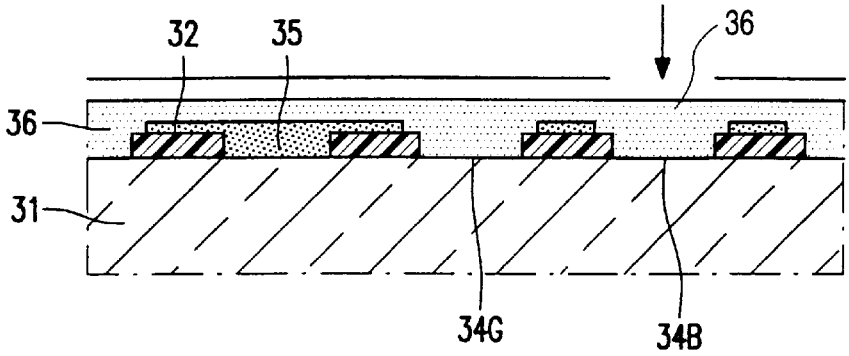
Figure 3H:
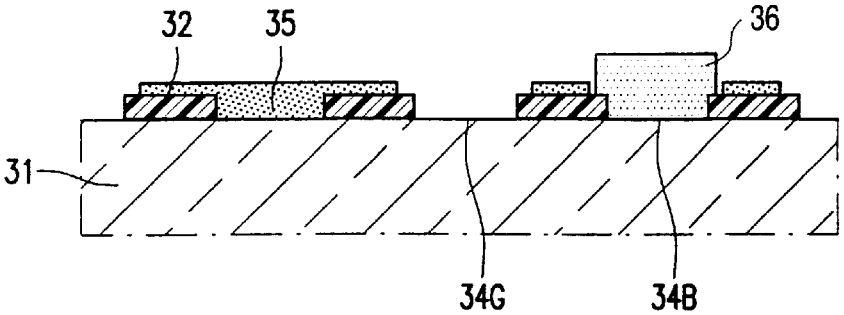
Figure 3I:
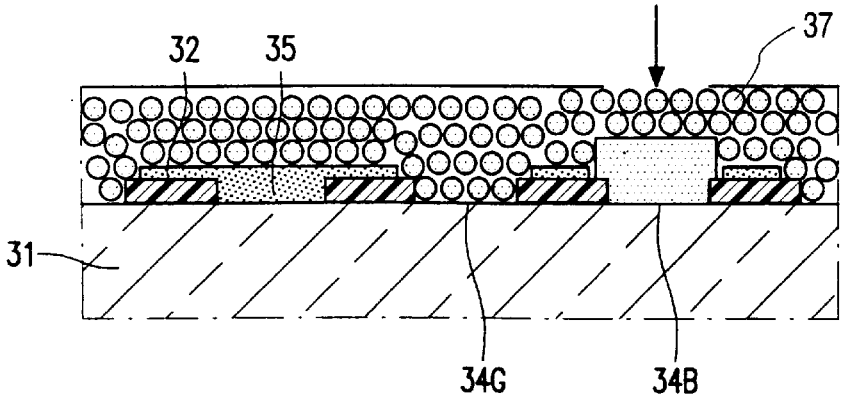
Figure 3J:
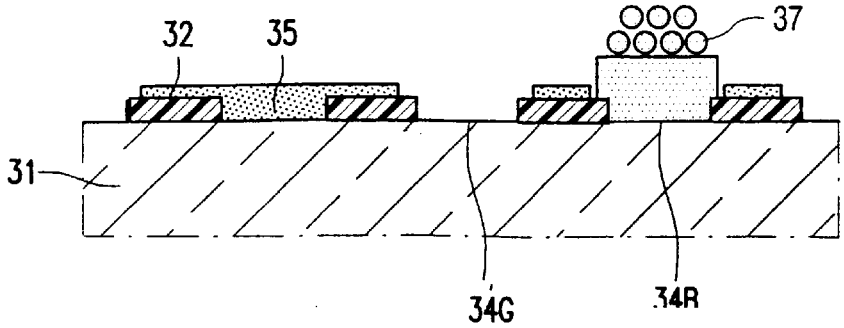

An example of a method of providing color-filter layers for a color display device in accordance with the invention is illustrated in FIGS. 3A through 3I. This method comprises the following steps.

a. Application of a black matrix 32 to a substrate 31; this operation can be carried out by means of known methods (FIG. 3A).

b. Application of a layer of a photoresist 33 to the substrate, exposure of said photoresist in and around the apertures 34B and 34G in the black matrix. Said exposure is preferably carried out such that the exposed regions overlap the apertures in the black matrix and an edge around said apertures (FIG. 3B and 3C).

c. Removal of the unexposed photoresist (FIG. 3D).

d. Application of a suspension 35 containing a first, for example red, dye. Drying the suspension (FIG. 3E).

e. Removal of the photoresist along with the dried suspension present on said photoresist (FIG. 3F).

f. Provision of a photoresist suspension 36 containing a second, for example blue, dye. Exposure of the suspension through the mask (FIG. 3G).

g. Removal of the unexposed suspension 36. The thickness of the suspension 36 is such that the exposed "blue" regions of the color-filter layer project above the black matrix (FIG. 3H).

h. Application, if necessary, of a third, for example green, color-filter layer. When a third color-filter layer is applied, preferably the following relationship applies $|t_1+t_{BM}-t_3|<|t_3-t_{BM}|$ and, preferably $|t_1+t_{BM}-t_3|<1$ micrometer. For example, $t_3$ is approximately 1 micrometer.

i. Provision of the photosuspension 37 which contains blue-luminescent phosphors. Exposure of said photosuspension (FIG. 3I).

j. Removal of unexposed photosuspension 37 (FIG. 3J).

The recognition on which the invention is based can be summarized as follows: the rheological behavior of the suspension and/or the evaporation of volatile constituents is influenced by the topology of the color-filter layers; in particular, projecting color-filter layers i.e. color fiter layers which project above their surroundings exert an influence. As a result, as explained hereinabove, variations occur in the thickness of the phosphor layers 25R and/or 25G and/or 25B. By reducing the differences in height between a projecting color-filter layer and the black-matrix layer, the variations in thickness of the phosphor layers are reduced and hence the quality of the picture displayed is improved. The invention leads to a reduction of the differences in height and hence to a reduction of the variations in thickness between the phosphor layers and, consequently, to an improved quality of the picture displayed.

Subsequently, in this example, the other phosphors (green and blue) are provided by means of known techniques.

It will be obvious that the invention is not limited to the examples described hereinabove. For example, in FIG. 1 a conventional color-cathode ray tube is shown. Within the scope of the invention, the term "color-display device" should be interpreted in a broad sense so as to include any display device comprising a pattern of phosphors in three luminescent phosphors on a substrate. Color display devices include flat display devices of various types, such as plasma displays. Materials which can be used for the color filters are e.g. iron oxide for red color filters, cobalt aluminate for blue color filters and CoO, NiO, TiO and NiO for green color filters.

We claim:

1. A color display device comprising a substrate on which a black-matrix layer having a first and a second series of apertures is provided, said color display device having a phosphor pattern for emitting, in operation, light through the apertures in the black-matrix layer, and color-filter layers extending between the phosphor pattern and the substrate, characterized in that a first color-filter layer extends over the first series of apertures in the black matrix, which apertures correspond to phosphor regions of a first color, and over a part of the black-matrix layer, with apertures being provided in the first color-filter layer, which apertures in the first color-filter layer correspond to the second series of apertures in the black matrix, and a second color-filter layer extends in apertures of a second series of apertures in the black matrix, and in that the following relationship applies $$|t_1+t_{BM}-t_2|<|t_2-t_{BM}|$$

wherein $t_1$ is the thickness of the first color-filter layer on the black-matrix layer near the second series of apertures, $t_{BM}$ is the thickness of the black matrix and $t_2$ is the thickness of the second color-filter layer.

2. A color display device as claimed in claim 1, characterized in that the size of the apertures provided in the first color-filter layer is such that said apertures correspond to the apertures of the second series, which apertures of the second series are surrounded by an edge.

3. A color display device as claimed in claim 1, characterized in that $|t_1+t_{BM}-t_2|<1$ micrometer.

4. A color display device as claimed in claim 1, wherein the color display device comprises a third color-filter layer and $$|t_1+t_{BM}-t_3|<|t_3-t_{BM}|$$

wherein $t_3$ is the thickness of the third color-filter layer.

* * * * *